US006057806A

United States Patent [19]

Lopez

[11] Patent Number: 6,057,806

[45] Date of Patent: May 2, 2000

[54] CROSS-POLARIZED AROUND-TOWER CELLULAR ANTENNA SYSTEMS

[75] Inventor: Alfred R. Lopez, Commack, N.Y.

[73] Assignee: Marconi Aerospace Systems Inc., Greenlawn, N.Y.

[21] Appl. No.: 09/100,822

[22] Filed: Jun. 19, 1998

[51] Int. Cl.[7] ..... H01Q 1/12

[52] U.S. Cl. ..... 343/890; 343/892; 455/561; 455/562

[58] Field of Search ..... 343/890, 891, 343/892, 720; 455/561, 562; H01Q 1/12

[56] References Cited

U.S. PATENT DOCUMENTS

| | | | |
|---|---|---|---|
| 5,497,166 | 3/1996 | Mahnad | 343/795 |
| 5,581,260 | 12/1996 | Newman | 342/374 |
| 5,872,548 | 2/1999 | Lopez | 343/890 |
| 5,887,267 | 3/1999 | Fugaro | 455/561 |

*Primary Examiner*—Hoanganh Le
*Assistant Examiner*—Shih-Chao Chen
*Attorney, Agent, or Firm*—Edward A. Onders; Kenneth P. Robinson

[57] ABSTRACT

Omnidirectional cellular coverage may be provided by installing four 90 degree antennas on the sides of a tower. However, in a prior system pattern uniformity will be destroyed by nulling effects if the tower width causes the lateral separation between adjacent antennas to be large. Nulling effects in areas of overlap between beams of adjacent antennas are avoided by providing an omnidirectional pattern characterized by signal polarization which changes with azimuth. Cross polarization of adjacent antennas is achieved by providing North and South antennas with +45 degrees linear polarization and East and West antennas with −45 degrees linear polarization (alternating antennas with right and left circular polarizations may also be used). Portable cellular receivers for use with the antenna system may typically utilize antennas with either vertical or horizontal linear polarization. Polarization mismatches between transmitting and receiving antennas are partially offset by scattering effects in the vicinity of the cellular receiver.

27 Claims, 5 Drawing Sheets

CROSS-POLARIZED AROUND-TOWER CELLULAR ANTENNA SYSTEMS

SEQUENCE LISTING (Not Applicable)

RELATED APPLICATIONS (Not Applicable)

FEDERALLY SPONSORED RESEARCH (Not Applicable)

BACKGROUND OF THE INVENTION

This invention relates to cellular antenna systems and, more particularly, to such systems capable of providing omnidirectional azimuth coverage without coverage reduction due to inter-beam nulling effects, when mounted around the periphery of a large structure.

Increased use of cellular communication systems results in an expanding need for towers or other structures suitable for the mounting of cellular antennas. For many cellular applications the ideal configuration is an antenna system mounted on the top of a tower and arranged to provide omnidirectional azimuth coverage (i.e., substantially uniform coverage 360 degrees around the tower horizontally). However, a combination of factors, including increasing demand and limited supply of suitable towers, plus public objection to new tower locations and proliferation, tends to limit availability and increase the cost of suitable tower top locations for new antenna systems.

Additional antenna mounting locations are available even after the desirable mounting locations at the top of existing towers are occupied. Such locations exist on the sides of large towers and the sides of buildings and other structures. These side locations (e.g., on the side of a large tower) are suitable for many applications not requiring omnidirectional azimuth coverage (e.g., coverage in only a 45 or 90 degree sector).

An attempt can be made to provide omnidirectional coverage from the sides of a large tower. However, with use of four 90 degree beamwidth antennas, for example, the width of the side of a large tower can typically result in the individual antennas being spaced apart laterally by a number of wavelengths at an operating frequency. A result of such arrangement will be that a cellular user located at a distance from the antenna system may be positioned at an azimuth where the lateral edge portions of the beam patterns from two adjacent antennas overlap, so that the user's cellular receiver receives signals from both of the two antennas. Under such circumstances, differences in the path lengths from the two antennas to the cellular receiving antenna may result in signals from one antenna arriving out of phase with signals from the other antenna. The two signals may thus partially or completely cancel each other, so that no usable signal level can be received by the user. The user is thus located in a signal null region of some width and range, which will be typical of a pattern of such null regions at different azimuths around the antenna system. In these null regions the signals from two adjacent widely-spaced antennas cancel each other to a varying degree depending on actual range and azimuth from the transmitting antenna system. The resulting areas of low or no signal reception at various locations thus limit the quality and uniformity of coverage achievable. This nulling characteristic and the resulting limitation on uniform omnidirectional coverage is specifically recognized in *ANTENNA ENGINEERING HANDBOOK*, R. Johnson, Third Edition, McGraw Hill, 1993. At page 27–18 it is stated:

> VHF/UHF base-station antennas are sometimes situated on the bodies of large towers, perhaps up to 10 m (30 ft.) in diameter. It is not economically possible to provide smooth omnidirectional coverage from such a large structure.

This unequivocal conclusion in an antenna handbook reflects the accepted understanding in the prior art that from mounting locations on the sides of a large tower, and using a reasonable number of antennas, smooth omnidirectional coverage was not possible because of signal nulls in overlapping beam areas. Of course, more uniform coverage could be physically achieved by use of a large number of narrow beam antennas, with narrow lateral separation between antenna mounting positions. However, typically it is not an economically feasible solution to use a large number of closely spaced antennas all the way around a large structure.

Systems including interspersed antennas of differing polarization have been described in different configurations for different purposes. See for example U.S. Pat. No. 5,724,666, issued Mar. 3, 1998. However, known prior systems typically do not transmit overlapping same frequency simultaneous beams from widely spaced antennas, and do not describe how to avoid nulling effects which degrade reception from such beams.

Objects of the invention are, therefore, to provide new and improved cellular antenna systems, and such systems providing one or more of the following characteristics and advantages:

- suitability for use on the sides of wide towers or other large structures;
- improved omnidirectional coverage with antenna-to-antenna lateral spacings of 5, 10, 50 or more wavelengths;
- omnidirectional coverage with signal polarization varying with azimuth;
- adjacent antennas having cross polarization to prevent null effects;
- multibeam capability with low system complexity;
- reduced signal processing losses; and
- circularly polarized cell antennas for operation with linearly polarized user receiver antennas.

SUMMARY OF THE INVENTION

In accordance with the invention, a cellular antenna system includes widely spaced antennas with reduced nulling of signals transmitted to a user antenna located in a beam overlap region. The system provides a composite omnidirectional radiation pattern having polarization varying with azimuth (e.g., right circular to left circular) to communicate with a user antenna having a reference polarization (e.g., vertical linear). The antenna system includes a support structure having lateral dimensions of at least 1.5 wavelengths at an operating frequency. A plurality of antennas are positioned around a support structure to provide omnidirectional azimuth coverage, with aperture centers of at least some adjacent antennas laterally separated by at least 1.5 wavelengths at said operating frequency, said plurality including (i) a first set of antennas, each having a beam pattern of a first polarization, and (ii) a second set of antennas, each at a position between two antennas of said first set and each having a beam pattern of a cross polarization, the beam patterns of antennas of said first set having beam overlap regions with beam patterns of adjacent antennas of said second set. An input port is provided to accept a cellular transmission signal. The system also includes a network, coupled to the input port, to provide a portion of the transmission signal to each antenna. The system provides improved signal transmission into the beam overlap regions as a result of non-nulling characteristics of the cross-polarized beams.

Pursuant to the invention, the plurality may consist of four antennas with respective pointing directions of North, East, South and West, with each antenna of the first set (e.g., North and South) configured to radiate signals of a first linear polarization (e.g., +45 degrees linear polarization) and each antenna of the second set (e.g., East and West) configured to radiate signals of a second linear polarization (e.g., −45 degrees linear polarization). Signals of such polarizations may be provided by a cellular antenna system for reception by a user antenna having vertical linear or horizontal linear polarization, for example. Alternatively, antennas of the first set may operate with right circular polarization and antennas of the second set with left circular polarization for communication with a linearly polarized user antenna mounted on a portable receiver.

A significant capability of the invention is that omnidirectional coverage with reduced nulling may be provided by widely spaced antennas mounted on the sides of a large tower or other structure. Lateral separations between adjacent antennas may exceed 5, 10, 50 or more wavelengths. at an operating frequency. Dead regions, which would be caused by signal nulling in such an installation using a prior art antenna system, are avoided by the cross polarization of signals associated with adjacent antennas of systems utilizing the invention.

For a better understanding of the invention, together with other and further objects, reference is made to the accompanying drawings and the scope of the invention will be pointed out in the accompanying claims.

DESCRIPTION OF THE INVENTION

Figure 1:
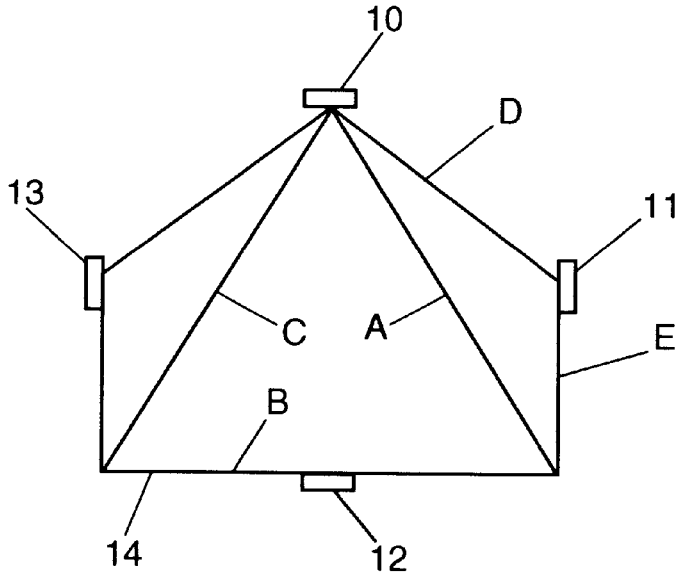
FIG. 1 is a simplified plan view illustrating four panel antennas structurally supported on the sides of a triangular tower of relatively large cross-section.
Figure 2:
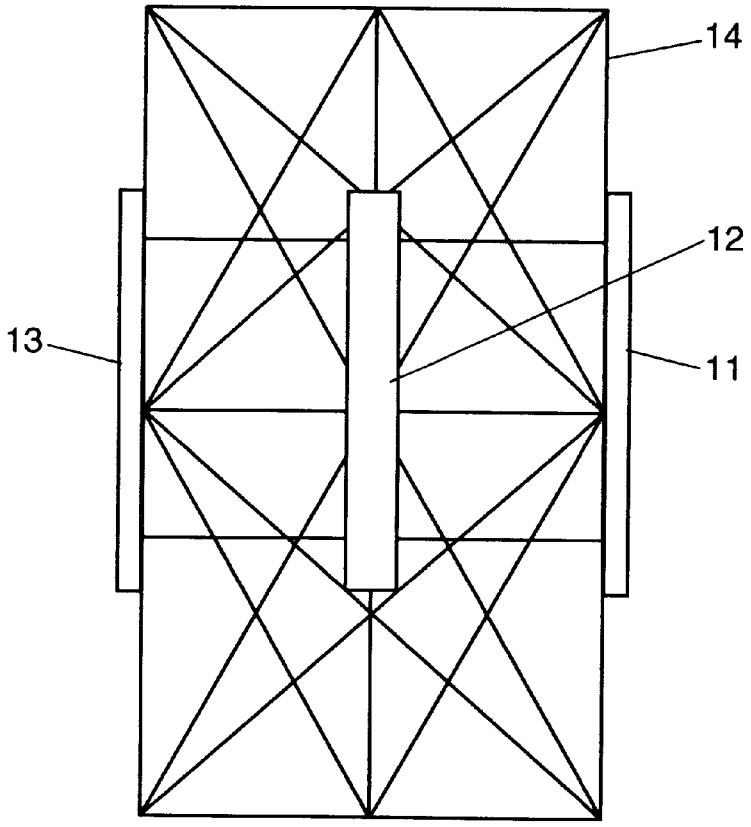
FIG. 2 is a side view of the FIG. 1 tower mounting arrangement, in which three of the four panel antennas are visible.

Pursuant to the invention, antennas intended to provide omnidirectional azimuth coverage need not be mounted in close proximity to each other around a pole or at the top of a tower. FIG. 1 shows a cross section of a support structure in the form of a large triangular tower, which at the level of this cross section may have sides A, B and C about 22 feet wide, for example. As shown, structural elements such as D and E have been added to enable a plurality of four antennas 10, 11, 12, 13, shown with respective North, East, South and West aiming directions, to be mounted on the sides of the triangular tower 14. FIG. 2 is a side view of the same antenna configuration with antennas 11, 12 and 13 visible. Antennas 10–13 may be panel type antennas, each including one or more vertical arrays of dipoles to provide a beam of nominally 90 degrees azimuth beamwidth, with elevation beamwidth as appropriate for a particular installation. As will be further discussed, in accordance with the invention antennas 10 and 12 are configured to radiate signals of a first polarization and antennas 11 and 13 are configured to radiate with a cross polarization. For example, antennas 10 and 12 may be configured for +45 degrees linear polarization and antennas 11 and 13 for −45 degrees linear polarization. Alternatively, antennas 10 and 12 may be configured for right circular polarization and antennas 11 and 13 for left circular polarization. In both of these examples antennas 11 and 13 will be considered to operate with "cross polarization" relative to antennas 10 and 12, for definitional purposes. While the support structure in this example is a triangular tower, in other installations the support structure may be a circular water tower or a square or rectangular building structure of a size such that the aperture centers of the individual antennas 10–13 are laterally separated by at least 1.5 wavelengths at an operating frequency. As noted, such antenna-to-antenna lateral separations may be 5, 10, 50 or more wavelengths.

It will be appreciated that an "antenna system" is not merely a collection of hardware components. An antenna system comprises components arranged in a particular configuration. With respect to the present invention, the system configuration includes antennas positioned with aperture centers laterally separated by 1.5 or more wavelengths. No prior system is known to operate with reduced nulling for same frequency simultaneous transmission to provide omnidirectional coverage using such widely spaced antennas. The invention provides a new class of antenna systems including antennas spaced by at least 1.5 wavelengths and operating with reduced nulling in beam overlap regions.

Figure 3:
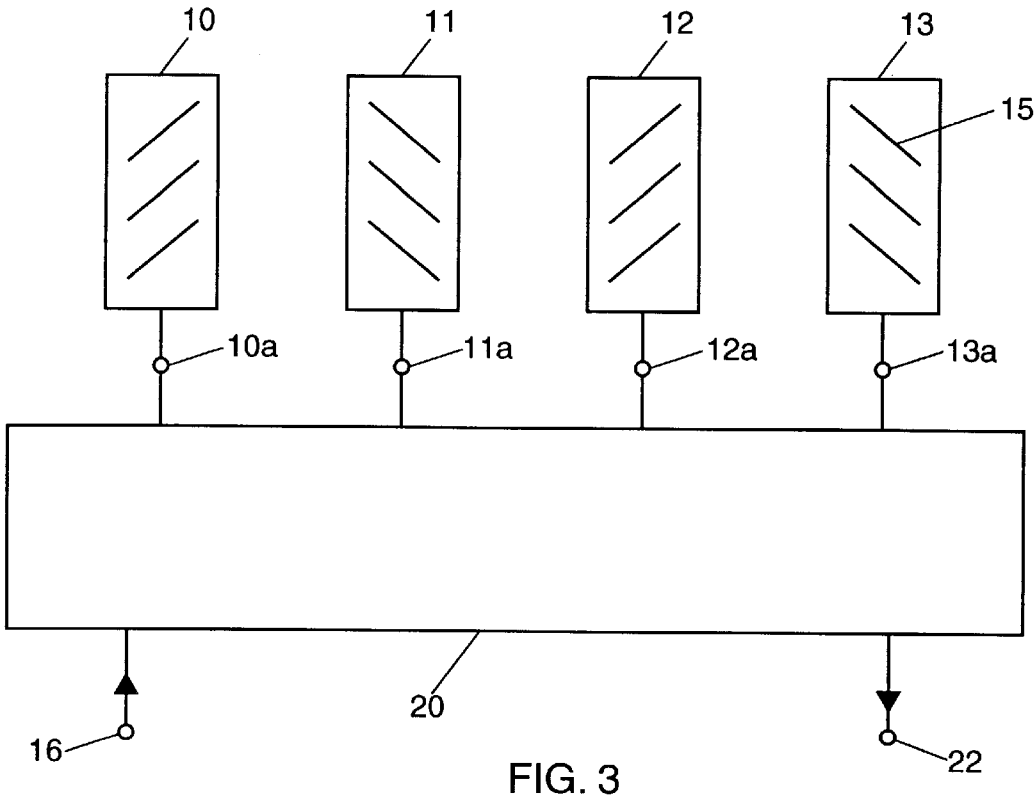
FIG. 3 is a simplified block diagram of a cellular antenna system in accordance with the invention including a network block feeding four antennas (e.g., the FIG. 1 antennas).

Referring now to FIG. 3, there is illustrated a cellular antenna system pursuant to the invention. Antennas 10–13 correspond to the similarly labeled antennas of FIG. 1 and may be assumed to be mounted on the sides of a tower as discussed with reference to FIGS. 1 and 2. As shown in FIG. 3, the individual diagonal lines (such as representative line 15 aligned at −45 degrees) represent the +45 and −45 degree dipoles of vertical dipole arrays included in respective ones of antennas 10–13. Thus, antennas 10 and 12 are represented as including +45 degree dipoles in vertical arrays effective to provide a beam pattern of +45 degree linear polarization, which is nominally 90 degrees wide in azimuth. Correspondingly, antennas 11 and 13 are configured to provide similar patterns of −45 degree linear polarization (i.e., a cross polarization, relative to antennas 10 and 12) which are also nominally 90 degrees in width.

It will be appreciated that when the antennas 10–13 of FIG. 3 are mounted as illustrated in FIG. 1, antennas 10 and 12 can be considered as a first set of antennas and antennas 11 and 13 as a second set, with no two antennas of the same set adjacent to each other. Thus, pursuant to the invention, adjacent antennas are cross polarized and if six, eight or another even number of antennas were utilized in a different application, such antennas would be divided into two sets of cross-polarized antennas. The two sets of antennas can then be mounted around a tower or other structure with each antenna of the second set at a position between two antennas of the first set. The result is that if a given antenna has a first polarization, each adjacent antenna will be configured to radiate with a cross polarization. As described, the FIG. 3 antenna system thus includes a plurality of antennas 10–13 at positions around a support structure (e.g., tower 14) to provide omnidirectional azimuth coverage. The plurality of antennas includes (i) a first set of antennas 10, 12 each with a beam pattern of a first polarization (+45 degrees linear) and (ii) a second set of antennas 11, 13 each with a beam pattern of a cross polarization (−45 degrees linear).

The FIG. 3 antenna system also includes an input port 16 and a network 20. Input port 16 is provided to accept a cellular transmission signal to be transmitted via the antenna system. Network 20 is coupled to input port 16 and arranged to simultaneously provide a portion of the transmission signal to each antenna 10, 11, 12, 13 of the plurality of antennas. The word "simultaneously" is used to indicate the signals arrive at each antenna in overlapping time periods, without requiring that timing be precisely identical in particular embodiments (e.g., where circuit elements may introduce minor delays or timing differences). With an understanding of the invention, skilled persons will be capable of providing a network 20 of suitable configuration to provide equal portions of the input signal to each antenna, for example. Configurations of network 20 which are considered particularly suited to achieving benefits of the invention will be described in greater detail with reference to FIGS. 4, 5 and 7.

As noted in the background discussion above, with particular reference to the *ANTENNA ENGINEERING HANDBOOK* of Johnson, in the prior art it was generally accepted knowledge that as a practical matter it was not economically feasible to provide smooth omnidirectional coverage by use of antennas mounted on the sides of a large tower or other structure. Of course, a large number of antennas could be used, so that lateral spacing between adjacent antennas would be small even on a large structure. However, inclusion of the large number of antennas which would be required is typically not practical for economic reasons.

The problem was that if an attempt was made to provide omnidirectional coverage by use of four antennas widely spaced (e.g., by 1.5 wavelengths or more) around a structure, nulling effects would destroy omnidirectional uniformity by reducing the signal level available for reception in beam crossover regions. For antenna-to-antenna lateral aperture center separations of less than 1.5 wavelengths pattern nulling or scalloping effects generally represent less than 4 dB of pattern gain reduction (representing a minimum in maximum range coverage) which may be an acceptable system parameter. Thus, with four 90 degree beamwidth antennas with 0, 90, 180 and −90 degree aiming directions, for example, beam crossover regions will be centered at 45, 135, 225 and −45 degrees. If the adjacent antennas of an antenna system are sufficiently spaced apart laterally, a receiving antenna can be at a point in a crossover region at which a signal of a given phase from one antenna is completely canceled by a signal from an adjacent antenna which differs in phase by 180 degrees. For this effect, the antenna separation and transmission path geometry to the receiving antenna must be such that the path lengths can differ by 180 degrees at the signal frequency. Under these conditions nulling effects occur and signals may fully or partially cancel each other at the receiving antenna. It will be appreciated that where four "90 degree" antennas facing North, East, South and West are used to cover successive 90 degree azimuth sectors for 360 degree coverage, beam overlap between adjacent beams is unavoidable and beam crossover regions will be produced centered at 45, 135, 225 and −45 degrees.

The present invention avoids this problem by making it impossible for the signals from adjacent antennas to cancel each other to produce nulls in the composite radiation pattern. Regardless of path length differences causing signals from adjacent antennas to simultaneously arrive at a receiving antenna in an out-of-phase relationship, cross-polarized signals do not cancel each other to produce pattern nulls. Thus, even if out-of-phase +45 and −45 degree linearly polarized signals of the same frequency arrive at a receiving antenna simultaneously, there is no resulting signal cancellation. The same is true for an antenna receiving out-of-phase right and left circularly polarized signals.

The preceding discussion concerning the overcoming of nulling effects does not address reception of transmitted cross-polarized signals by a cellular user. Under typical prior arrangements a user utilizes a receiving antenna of the same polarization as the transmitting antenna (e.g., an antenna of vertical linear polarization to receive transmitted signals having vertical linear polarization). Pursuant to the present invention a user may utilize an antenna having either vertical linear polarization or horizontal linear polarization in reception of the cross-polarized signal sets discussed above (other linear polarization can also be used in reception of the circularly cross-polarized signal set). Under such conditions, it will be appreciated that there will be a polarization mismatch at the receiving antenna.

Under "ideal" conditions an antenna having vertical linear polarization would be completely ineffective for reception of signals transmitted with horizontal linear polarization. The same is not true for an antenna with vertical linear polarization receiving a +45 degree linear polarization signal. There will be a polarization mismatch loss, however, a portion of the signal reaching the antenna will be received. Successful reception under such circumstances thus depends on the power of the transmitted signal and the minimum signal level required by the receiver to provide reliable reception. As a practical matter, the local environment in the vicinity of a receiving antenna mounted on a portable cellular receiver will typically include buildings, trees, motor vehicles or other objects with reflective and absorptive properties which will have a polarization altering or randomizing effect on the signal actually incident on the receiving antenna. It has been calculated that in the critical region at maximum system range, the local environment will randomize the signal polarization to the extent that the average polarization mismatch loss for a system using the invention will be of the order of 3 dB, independent of the incident polarization. On this basis, the invention will enable the sides of a large tower or other structure to be used to mount a plurality of antennas achieving omnidirectional coverage, subject to acceptance of up to 3 dB loss in received signal strength due to polarization mismatch. Such a loss characteristic can be readily accommodated in many applications. A large number of additional antenna mounting locations (other than the choicest most expensive top of the tower locations) are thus made available to provide signal transmission performance acceptable for many cellular system applications.

With one transmitting antenna having +45 degrees linear polarization and the adjacent antenna having −45 degrees linear polarization, a receiving antenna on the center line of the beam of one of the transmitting antennas will basically receive a linearly polarized signal of either +45 or −45 degrees linear polarization (ignoring, for the present discussion, randomizing effects). The actual polarization variation with azimuth will actually be more complex than a simple alternation of the two polarizations. Assume North and South transmitting antennas with +45 degree linear polarization and East and West antennas with −45 degrees linear polarization (see FIGS. 1 and 3). For widely-spaced antennas, as discussed, the transmission path differences will result in polarization variation starting with +45 degree linear polarization in the region to the North of the transmitting antennas and, upon entering the region of adjacent beam overlap centered around 45 degrees azimuth, sequentially changing to polarizations of vertical linear, right circular, horizontal linear, left circular and vertical linear, before changing to −45 degrees linear polarization in the region to the East of the transmitting antennas. These polarization changes will occur within one cycle of path difference (i.e., path differences from adjacent antennas which vary from zero to one full wavelength as the receiving antenna moves in azimuth). It will thus be seen that for a receiving antenna with vertical linear polarization there can be an azimuth at which the composite of signals incident from two transmit antennas has a nominal horizontal linear polarization. The effects of such polarization incompatibility are mitigated by both polarization randomization and by the fact that the resulting total mis-polarization effect will be both narrow, as measured in azimuth, and shallow, as measured inward from nominal maximum system range.

On a similar basis, for a North antenna with right circular polarization and an East antenna with left circular polarization pursuant to the invention, polarization changes in the beam crossover region centered at 45 degrees azimuth can be from right circular sequentially to vertical linear, +45 degrees linear, horizontal linear, −45 degrees linear, and vertical linear, before changing to left circular in the region to the East of the transmitting antennas. In either the linear or circular example, the invention enables omnidirectional coverage to be more uniformly provided, as compared to the severe nulling effects which were recognized in the prior art as making it impossible to provide practical omnidirective coverage from antennas mounted on the sides of a large tower or other large structure.

FIGS. 4–7

Figure 4:
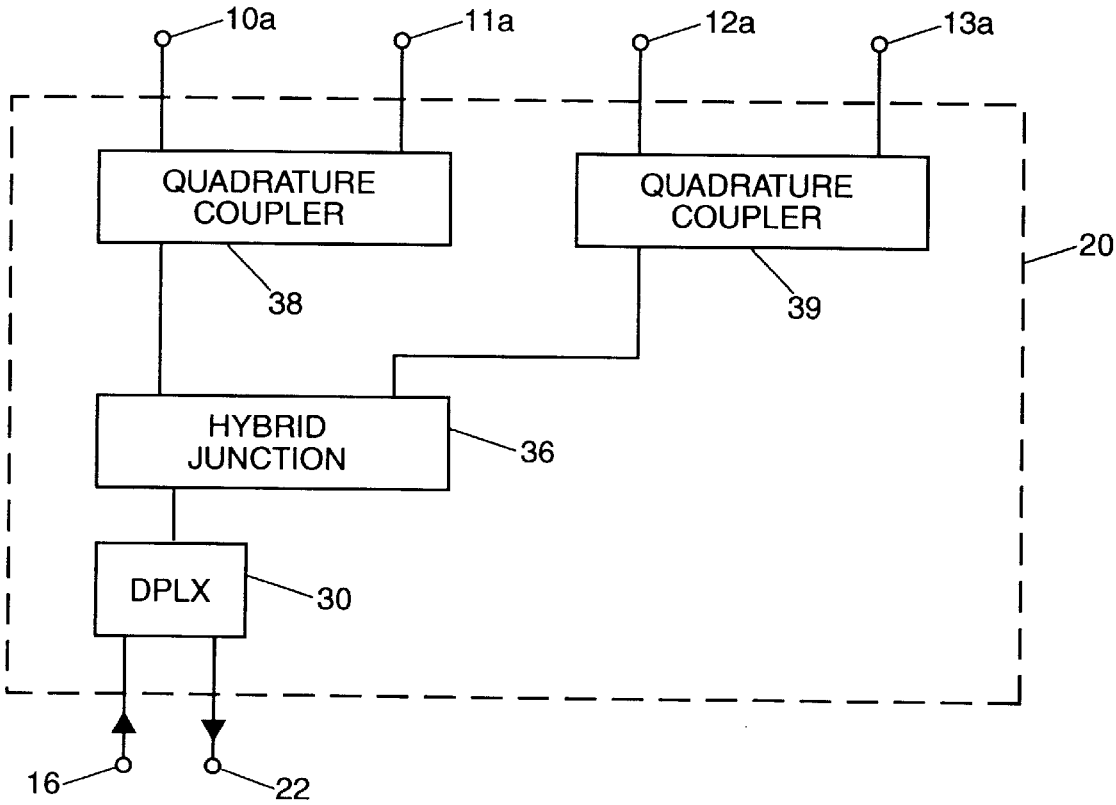
FIG. 4 provides additional details of a second configuration of the FIG. 3 network block pursuant to the invention.

Referring now to FIGS. 4–7, there are illustrated currently preferred embodiments of network block 20 of FIG. 3 usable in implementation of the invention and to achieve further advantages pursuant to the invention. In FIG. 4, network 20 includes a duplexer, shown as DPLX 30, coupled to input port 16. A hybrid junction 36 is coupled to duplexer 30 and includes first and second outputs respectively coupled to first quadrature coupler 38 and second quadrature coupler 39. As shown, first quadrature coupler 38 is coupled between the first output of hybrid junction 36 and each of two adjacent antennas (e.g., antennas 10, 11 of FIG. 3) via output ports 10*a* and 11*a*. Second quadrature coupler 39 is coupled between the second output of hybrid junction 36 and each of two adjacent antennas (e.g., antennas 12, 13 of FIG. 3) via output ports 12*a* and 13*a*. With this arrangement there is implemented on a simple, cost effective basis a network for distributing a transmission signal from input port 16 in equal portions to the North, East, South and West antennas 10–13 of FIG. 3. Since the antenna system, in accordance with the established functionality of antenna elements, is operative in a reciprocal manner for signal reception, duplexer 30 also provides a received signal output to reception port 22.

Figure 5:
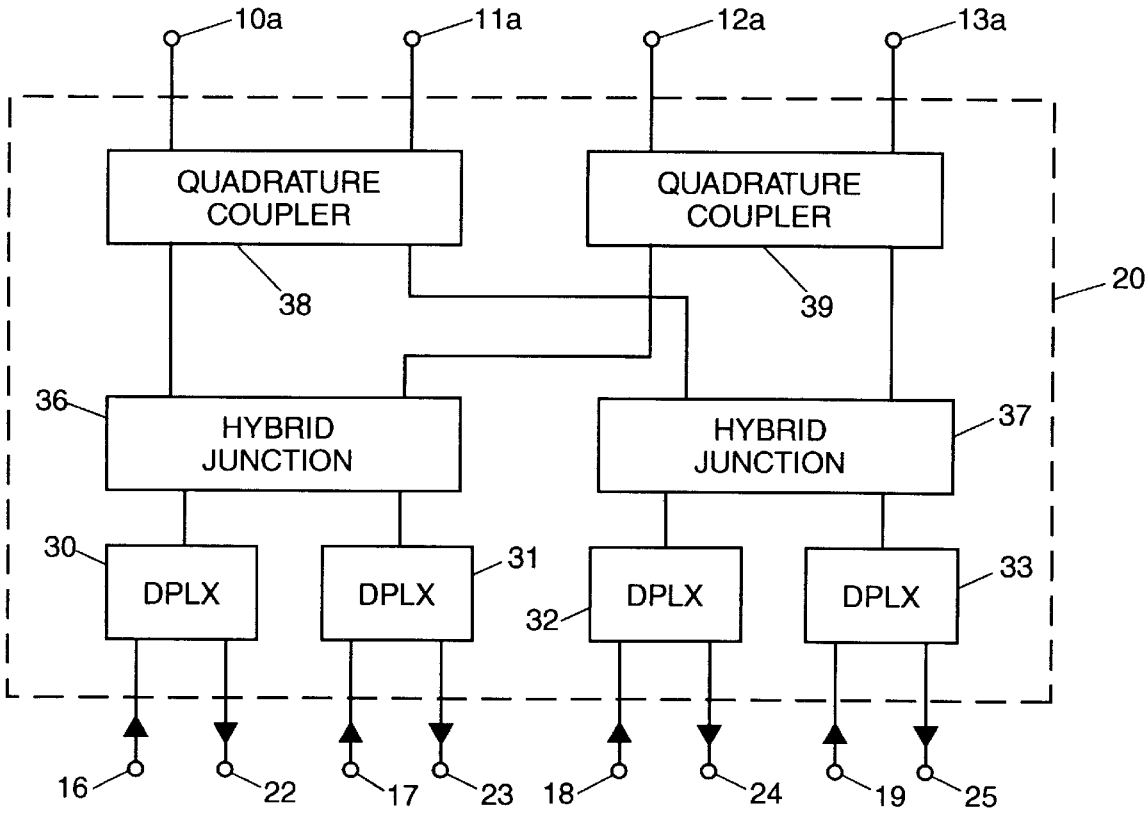
FIG. 5 provides additional details of a third configuration of the FIG. 3 network block pursuant to the invention.

In the FIG. 5 embodiment, the network 20 of FIG. 4 has been modified so to provide for operation with four omnidirectional transmit beams and four omnidirectional receive beams. As shown, a second duplexer 31 has been coupled to another port of hybrid junction 36 and a second similar combination of duplexers 32 and 33 and hybrid junction 37 has been added to network 20. In FIG. 5, the outputs of hybrid junction 37 are coupled to the quadrature couplers 38 and 39, which in turn are coupled via output ports 10*a*, 11*a*, 12*a*, 13*a* to four antennas, such as 90 degree antennas 10–13 of FIG. 3. As shown, the FIG. 5 arrangement provides four input ports 16, 17, 18, 19, each able to accept an independent transmission signal (e.g., four separate signals of the same carrier frequency). With the FIG. 5 configuration, adjacent antennas are diagonally cross polarized with quadrature phasing of signals provided by the combination hybrid junction/quadrature coupler feed configuration. As a result, a transmission signal input to any one of input terminals 16–19 is transmitted in an omnidirectional beam, having polarization varying with azimuth by the cross polarization of adjacent antennas. Also, as a result of the characteristics of hybrid junctions and quadrature couplers, the omnidirectional beam resulting from signal input at one input port (e.g., input port 16) will have quadrature phasing relative to the omnidirectional beams resulting from inputs at any of the other input ports (e.g., input ports 17–19). The FIG. 5 configuration thus provides a simple and economical implementation of an antenna system capable of providing four independent omnidirectional beams from cellular transmission signals provided to four input ports. By the principals of reciprocal operation, signals received via four omnidirectional receive beams are made available at respective output ports 22–25.

Figure 6:
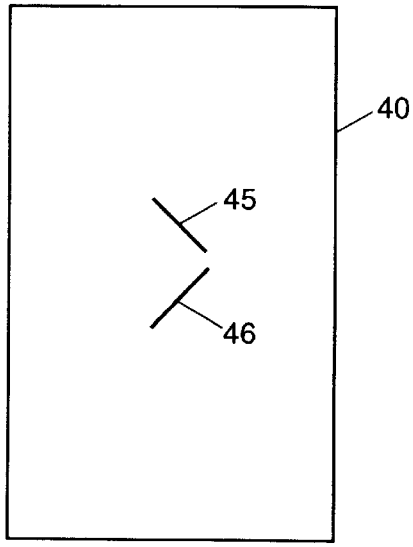
FIG. 6 is a simplified diagram illustrating the use of stacked −45 and +45 degree dipoles in antennas of the cellular antenna systems.

FIG. 6 is a simplified representation of a front view of a panel antenna 40 using a stacked −45 and +45 degree dipole pair 45, 46 suitable for operation with circular polarization. Utilizing known feed design techniques, dipoles 45, 46 can be excited in time quadrature so as to radiate and receive signals with right circular polarization or left circular polarization (e.g., via a separate port for each polarization). An actual panel antenna of this type may include one or more vertical arrays of dipole pairs like dipole pair 45, 46, in order to provide desired horizontal and vertical beamwidth characteristics.

Figure 7:
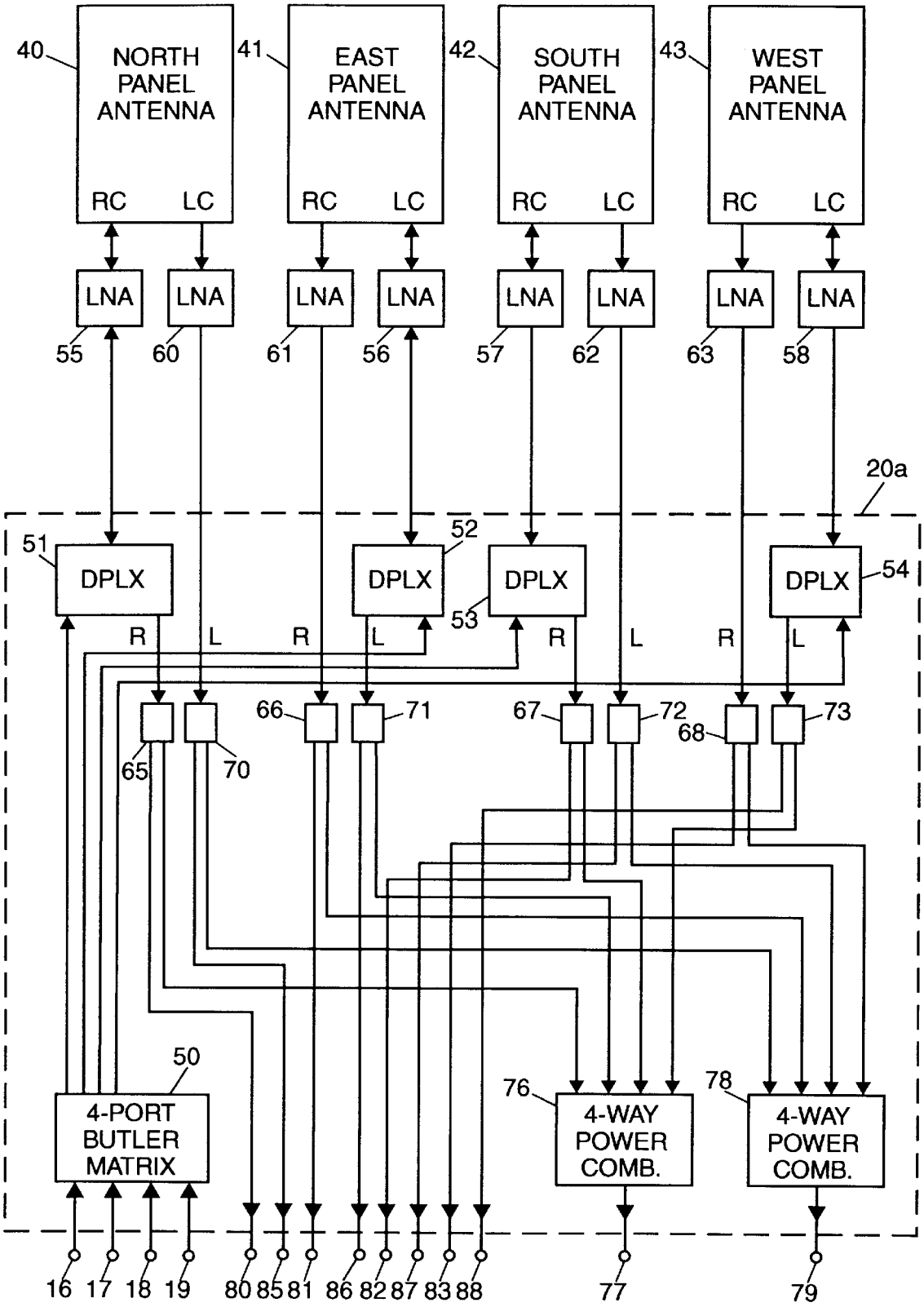
FIG. 7 provides additional details of a fourth configuration of the FIG. 3 network block feeding sets of right and left circularly polarized antennas pursuant to the invention.
Figure 8:
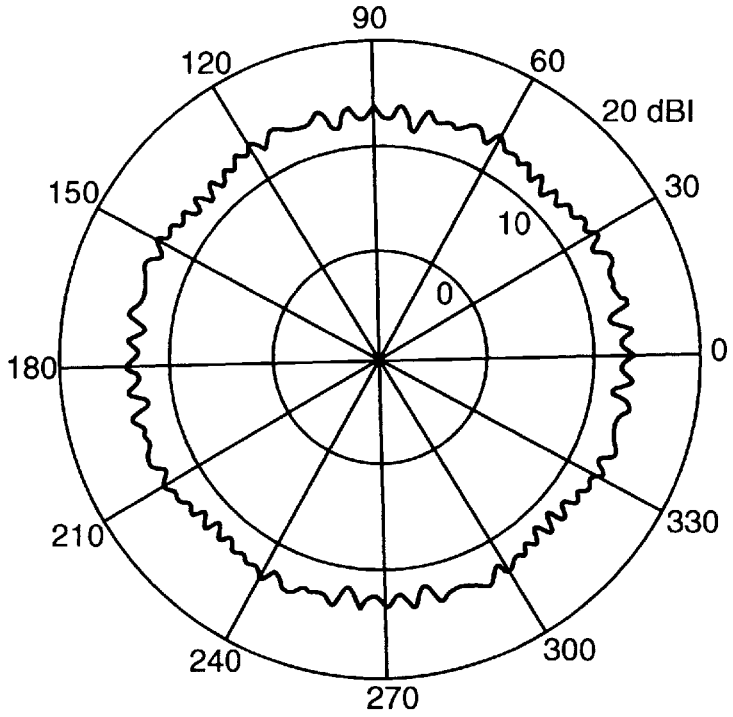
FIG. 8 is an antenna pattern computed for an omnidirectional transmit beam provided by four antennas mounted on the sides of a large tower and fed by the FIG. 7 configuration pursuant to the invention.
Figure 9:
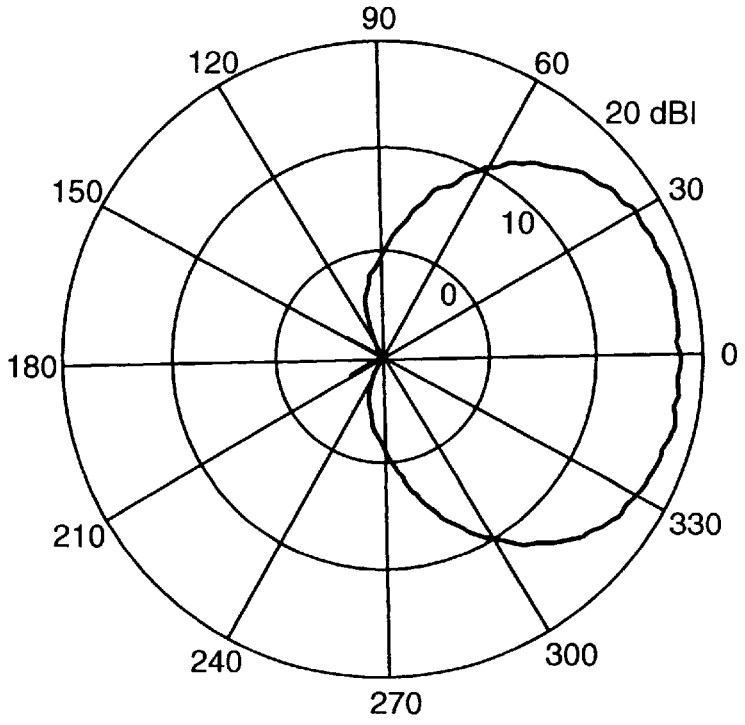
FIG. 9 is a 90 degree beamwidth pattern computed for a single quadrant receive beam option provided by the FIG. 7 configuration pursuant to the invention.

FIG. 7 illustrates a further embodiment of the invention utilizing North, East, South and West panel antennas 40, 41, 42 43 of the type described with reference to FIG. 6. The FIG. 7 antenna system has the capability of providing operation with four omnidirectional transmit beams, two omnidirectional receive beams, four 90 degree beamwidth receive beams of right circular polarization and four 90 degree beamwidth receive beams of left circular polarization. Each omnidirectional beam transitions from right to left circular polarization every 90 degrees of azimuth. Near ±45 degrees and ±135 degrees the polarization rotates between vertical and horizontal linear polarization.

As shown in FIG. 7, four input ports 16–19 are coupled to the inputs of a Butler type matrix 50 having four inputs and four outputs. Matrix 50 is effective to provide for each cellular transmission signal provided at one of the input ports 16–19, an output signal at each output of the matrix 50 which is orthogonal to output signals for each cellular transmission signal provided to any of the other of the input ports 16–19. As shown, each output of the Butler type matrix 50 is coupled to one of the antennas 40–43 via a respective one of duplexers 51–54. The respective coupling paths between the duplexers 51–54 and antennas 40–43 each includes a respective one of low noise amplifiers 55–58, which also provide a receive/transmit diplexer function, in order to implement transmit/receive operation with amplification of received signals. With antennas 40 and 42 arranged to radiate with right circular polarization and antennas 41 and 43 arranged to radiate with left circular polarization, the FIG. 7 arrangement provides a separate omnidirectional beam for an input at each of input ports 1619 and each such beam has a quadrature relationship relative to each other such beam.

For reception, each of antennas 40–43 is utilized to receive signals with right circular polarization and provide such signals to respective low noise amplifiers 55, 61, 57, 63. Each antenna is also utilized to receive signals with left circular polarization and provide such signals to respective low noise amplifiers 60, 56, 62, 58. As shown, signals received via a first omnidirectional beam (polarization: right circular N and S; left circular E and W) are coupled from amplifiers 55, 56, 57, 58 to respective ones of two-way power dividers 65, 71, 67, 73. One output of each of those power dividers is coupled to four-way power combiner 76, which provides an omnidirectional receive beam output at its output port 77. The remaining outputs of each of the power dividers 65, 71, 67, 73 provide individual 90 degree beamwidth outputs at output ports 80, 86, 82, 88. On a similar basis signals received via a second omnidirectional beam (polarization: left circular N and S; right circular E and W) are coupled via respective ones of two-way power dividers 70, 66, 72, 68 to four-way power divider 78 to provide an onmidirectional receive beam output at its output port 79. The remaining outputs of each of the power dividers 70, 66, 72, 68 provide individual 90 degree beamwidth outputs at output ports 85, 81, 87, 83.

With an understanding of the invention, skilled persons will be enabled to provide additional implementations of the invention utilizing four, six, eight or other even numbers of antennas and excitation networks suitable for particular applications. It should be understood that while the invention is particularly advantageous in providing omnidirectional coverage via antennas mounted on the side of a large tower or other structure, other configurations may also be employed. Thus, particular configurat ions of the invention may also advantageously be utilized with antennas positioned at the top of a tower or on the sides of a relatively thin tower or pole. Also, in some applications it may be desirable to provide antennas positioned to provide less than omnidirectional coverage (e.g., by using an even or odd number of antenna positions which extend only partically around a support structure to provide 270 degree azimuth coverage). With the invention, undesirable gaps in signal coverage due to nulling effects at beam cross-over between beams of adjacent antennas is not a problem, regardless of lateral separation between adjacent antennas. As a result, omnidirectional coverage can be provided by use of a reasonable number of antennas (e.g., four antennas) mounted on the sides of towers, water towers, buildings and other structures large enough to result in antenna-toantenna lateral separations of 50 wavelengths or more.

While there have been described the currently preferred embodiments of the invention, those skilled in the art will recognize that other and further modifications may be made without departing from the invention and it is intended to claim all modifications and variations as fall within the scope of the invention.

Claims:

1. A cellular antenna system, including widely spaced antennas with reduced nulling of signals transmitted to a user antenna located in a beam overlap region, comprising:

a support structure having lateral dimensions of at least 1.5 wavelengths at an operating frequency;

a plurality of antennas positioned around said support structure to provide omnidirectional azimuth coverage, with aperture centers of at least some adjacent antennas laterally separated by at least 1.5 wavelengths at said operating frequency, said plurality of antennas including (i) a first set of antennas, each having a beam pattern of a first polarization, and (ii) a second set of antennas, each at a position between two antennas of said first set and each having a beam pattern of a cross polarization, the beam patterns of antennas of said first set having beam overlap regions with beam patterns of adjacent antennas of said second set;

an input port to accept a cellular transmission signal; and a network, coupled to said input port, to simultaneously provide a portion of said transmission signal to each antenna;

the system providing improved signal transmission into said beam overlap regions as a result of non-nulling characteristics of the cross-polarized beams.

2. The cellular antenna system as in claim 1, wherein each antenna of said first set is configured to radiate signals of a first linear polarization and each antenna of said second set is configured to radiate signals of a second linear polarization normal to said first linear polarization.

3. The cellular antenna system as in claim 2, additionally including a user antenna located in a beam overlap region and having a linear polarization differing by 45 degrees from each of said first and second linear polarizations.

4. The cellular antenna system as in claim 1, wherein each antenna of said first set is configured to radiate signals of +45 degrees linear polarization and each antenna of said second set is configured to radiate signals of −45 degrees linear polarization, for reception by a user antenna having one of a vertical linear polarization and a horizontal linear polarization.

5. The cellular antenna system as in claim 1, wherein each antenna of said first set is configured to radiate signals of right circular polarization and each antenna of said second set is configured to radiate signals of left circular polarization, for reception by a user antenna having a linear polarization.

6. The cellular antenna system as in claim 1, wherein said antenna positions extend only partially around said support structure and the plurality of antennas provide azimuth coverage over a range of azimuth angles which is less than omnidirectional.

7. The cellular antenna system as in claim 1, wherein said plurality of antennas consists of four antennas, each providing coverage of a 90 degree azimuth quadrant, and said support structure has a periphery such that the lateral separation between adjacent antennas exceeds 5 wavelengths at said operating frequency.

8. The cellular antenna system as in claim 1, wherein said plurality of antennas consists of four antennas, and said network includes:

a duplexer coupled to said input port;

a hybrid junction coupled to said duplexer and including first and second outputs;

a first quadrature coupler coupled between said first output and each of two adjacent antennas of said plurality; and a second quadrature coupler coupled between said second output and each of the two remaining antennas of said plurality.

9. The cellular antenna system as in claim 8, additionally comprising:

a receiver coupled to said duplexer to receive user signals via reciprocal operation of the antenna system.

10. A cellular antenna system, including widely spaced antennas with reduced nulling of signals transmitted to a user antenna located in a beam overlap region, comprising:

a support structure having a lateral dimension of at least 1.5 wavelengths at an operating frequency;

first and second antennas positioned on said support structure with aperture centers laterally separated by at least 1.5 wavelengths at said operating frequency, said first antenna providing a first beam pattern of a first polarization and said second antenna providing a second beam pattern of a cross-polarization having a beam overlap region with said first beam pattern;

an input port to accept a cellular transmission signal; and is a network, coupled to said input port, to simultaneously provide a portion of said transmission signal to each antenna;

the system providing improved signal transmission into said beam overlap region as a result of non-nulling characteristics of the cross-polarized beams.

11. The cellular antenna system as in claim 10, wherein said first antenna is configured to radiate signals of a first linear polarization and said second antenna is configured to radiate signals of a second linear polarization normal to said first linear polarization.

12. The cellular antenna system as in claim 10, wherein said first antenna is configured to radiate signals of +45 degrees linear polarization and said second antenna is configured to radiate signals of −45 degrees linear polarization, for reception by a user antenna having one of a vertical linear polarization and a horizontal linear polarization.

13. The cellular antenna system as in claim 10, wherein said first antenna is configured to radiate signals of right circular polarization and said second antenna is configured to radiate signals of left circular polarization, for reception by a user antenna having a linear polarization.

14. The cellular antenna system as in claim 13, wherein said first antenna is configured to receive signals of left circular polarization and said second antenna is configured to receive signals of right circular polarization.

15. The cellular antenna system as in claim 10, wherein the lateral separation between the aperture centers of said first and second antennas exceeds 5 wavelengths at said operating frequency.

16. A cellular antenna system, providing a plurality of omnidirectional radiation beams each having polarization varying with azimuth to communicate with a user antenna having a reference polarization, the antenna system comprising:

a plurality of antennas at positions around a support structure to provide omnidirectional azimuth coverage, including (i) a first set of antennas, each having a beam pattern of a first polarization, and (ii) a second set of antennas, each at a position between two antennas of said first set and each having a beam pattern of a cross polarization, the beam patterns of antennas of said first set having beam overlap regions with beam patterns of adjacent antennas of said second set;

a plurality of input ports each to accept a cellular transmission signal; and a network, coupled to each said input port, to provide a portion of each said transmission signal simultaneously to each antenna of said plurality.

17. The cellular antenna system as in claim 16, wherein at least some of said adjacent antennas laterally separated by at least 1.5 wavelengths at an operating frequency.

18. The cellular antenna system as in claim 16, wherein said network is arranged to provide signals to each respective antenna from one input port in quadrature with the signal provided to each respective antenna from each other input port.

19. The cellular antenna system as in claim 16, wherein said pluralities of antennas and input ports each consist of four such elements, and said network includes:

four duplexers, one coupled to each said input port;

a hybrid junction coupled to two of said input ports and including first and second outputs;

a hybrid junction coupled to the two remaining input ports and including third and fourth outputs;

a quadrature coupler coupled between said first and third outputs and each of two adjacent antennas of said plurality; and a quadrature coupler coupled between said second and fourth outputs and each of the two remaining antennas of said plurality;

said antenna system arranged to provide four omnidirectional radiation beams each radiating the cellular transmission signal input to a different one of said input ports.

20. The cellular antenna system as in claim 19, additionally comprising:

four receivers, one coupled to each said duplexer, to receive user signals via said four omnidirectional radiation beams by reciprocal operation of the antenna system.

21. The cellular antenna system as in claim 16, wherein said pluralities of antennas and input ports each consist of four such elements, and said network includes:

a Butler type matrix having four inputs, one input coupled to each of said input ports, and four outputs, said matrix effective to provide for each cellular transmission signal an output signal at each said output which is orthogonal to output signals for each other cellular transmission signal; and four duplexers, one coupled between each said matrix output and one of said four antennas;

said antenna system arranged to provide four omnidirectional radiation beams each radiating the cellular transmission signal input to a different one of said input ports.

22. The cellular antenna system as in claim 21, wherein each antenna of said first set is configured to radiate with right circular polarization, each antenna of said second set is configured to radiate with left circular polarization.

23. The cellular antenna system as in claim 22, wherein each antenna of said plurality of antennas is configured to provide at a right circular port signals received via a right circular reception capability and provide at a left circular port signals received via a left circular reception capability, and wherein said network further includes:

a first four-way power combiner coupled to the right circular port of each antenna of said first set and the left circular port of each antenna of said second set, to provide a first combined received signal output representative of signals received in a first omnidirectional beam;

a second four-way power combiner coupled to the left circular port of each antenna of said first set and the right circular port of each antenna of said second set, to provide a second received signal output representative of signals received in a second omnidirectional beam.

24. The cellular antenna system as in claim 22, wherein each antenna of said plurality of antennas is configured to provide at a right circular port signals received via a right circular reception capability and provide at a left circular port signals received via a left circular reception capability, and wherein said network further includes:

four right circular output terminals, each coupled to the right circular port of one of said four antennas, each right circular output terminal providing a right circular received signal output representative of signals received in the beam pattern of a single antenna; and four left circular output terminals, each coupled to the left circular port of one of said four antennas, each left circular output terminal providing a left circular received signal output representative of signals received in the beam pattern of a single antenna.

25. The cellular antenna system as in claim 21, wherein each antenna of said first set is configured to radiate signals of a first linear polarization and each antenna of said second set is configured to radiate signals of a second linear polarization normal to said first linear polarization.

26. The cellular antenna system as in claim 21, additionally including a user antenna having a linear polarization differing by 45 degrees from each of said first and second linear polarizations.

27. The cellular antenna system as in claim 21, wherein each antenna of said first set is configured to radiate signals of +45 degrees linear polarization and each antenna of said second set is configured to radiate signals of −45 degrees linear polarization, for reception by a user antenna having one of a vertical linear polarization and a horizontal linear polarization.

* * * * *